US006901717B2

(12) United States Patent
Brunozzi et al.

(10) Patent No.: US 6,901,717 B2
(45) Date of Patent: Jun. 7, 2005

(54) POLE REINFORCING ARRANGEMENT

(75) Inventors: Jeffrey R. Brunozzi, Bloomsburg, PA (US); Brian R. Reese, Drums, PA (US); David D. Hawkins, Dublin, OH (US)

(73) Assignee: Pennsummit Tubular, LLC, West Hazelton, PA (US)

( * ) Notice: Subject to any disclaimer, the term of this patent is extended or adjusted under 35 U.S.C. 154(b) by 173 days.

(21) Appl. No.: 09/954,843

(22) Filed: Sep. 18, 2001

(65) Prior Publication Data

US 2002/0170261 A1 Nov. 21, 2002

Related U.S. Application Data

(60) Provisional application No. 60/291,539, filed on May 16, 2001.

(51) Int. Cl.[7] ..... E04C 3/34

(52) U.S. Cl. ..... 52/723.1; 52/721.4; 52/721.5; 52/723.1; 52/723.2; 52/724.5; 52/726.3; 52/730.1; 52/736.3; 52/736.4; 52/737.4; 52/737.5; 52/738.1; 52/726.4; 52/294; 52/296

(58) Field of Search ..... 52/721.4, 721.5, 52/723.1, 723.2, 724.5, 726.3, 730.1, 736.3, 736.4, 737.4, 737.5, 738.1, 726.4, 294, 296

(56) References Cited

U.S. PATENT DOCUMENTS

| | | | | |
|---|---|---|---|---|
| 919,771 A | | 4/1909 | Roberts et al. | |
| 2,327,681 A | | 8/1943 | Vanderveer | |
| 2,707,034 A | | 4/1955 | Hetrick | |
| 3,514,911 A | | 6/1970 | Preradovich | |
| 3,630,474 A | * | 12/1971 | Minor | 52/98 |
| 3,738,072 A | | 6/1973 | Adrian | |
| 4,218,858 A | * | 8/1980 | Legler | 52/165 |
| D273,712 S | * | 5/1984 | Ahlqvist | D25/77 |
| 4,756,130 A | | 7/1988 | Burtelson | |
| 4,987,718 A | | 1/1991 | Knight | |
| 5,568,909 A | * | 10/1996 | Timko | 248/519 |
| 6,108,996 A | | 8/2000 | McGinnis | |
| 6,219,991 B1 | | 4/2001 | Salek-Nejad | |
| 6,453,636 B1 | * | 9/2002 | Ritz | 52/736.4 |
| 2001/0013212 A1 | | 8/2001 | Jimenez Sanchez et al. | |

OTHER PUBLICATIONS

Communication Management Specialists, A Division of Scientel, "Tower Strengthening Program", undated brochure, 5 pages.

Sterling Engineering & Design Group, LLC, of Houston, TX, undated promotional brochure on "Self–Supported Towers, Guyed Mast Towers and Monopoles", 7 pages.

Towertek Industries of Hollywood, FL, "Reinforce and Modify Monoploe, SS and Guyed Towers Quickly and Painlessly", undated flyer, 1 page.

IC Engineering, Inc, of Cary, NC, "Monopole Reinforcement Sleeve System (MRSS)", undated slide presentation, 14 pages.

United Consulting of Norcross, GA, untitled and undated pormotional slide presentation on a "Tower Strengthening Program", 64 pages.

* cited by examiner

*Primary Examiner*—Carl D. Friedman
*Assistant Examiner*—Steve M Varner
(74) *Attorney, Agent, or Firm*—Greenberg Traurig, LLP

(57) ABSTRACT

Reinforcement arrangement for a pole including abase flange surrounding a bottom of the pole, elongate tubes connected to the base flange and arranged at discrete locations around a circumference of the pole to extend vertically alongside the pole and annular clamping collars arranged around the pole at different vertical locations. The tubes are attached to the clamping collars to thereby form a skeletal framework around the pole which provides increased load-bearing capability to the pole and enables installation of additional antennas on the pole. The base flange is supported above the base plate by gussets which are welded to the base plate and pole. The clamping collars are each formed from several collar segments, each extending partially around the circumference of the pole with adjacent collar segments being attached to one another.

22 Claims, 20 Drawing Sheets

POLE REINFORCING ARRANGEMENT

CROSS-REFERENCE TO RELATED APPLICATION

This application claims priority under 35 U.S.C. §119(e) of U.S. provisional patent application Ser. No. 60/291,539 filed on May 16, 2001, which is incorporated by reference herein.

FIELD OF THE INVENTION

The present invention relates generally to an arrangement for reinforcing poles or retrofitting poles to increase their strength and more particularly to an arrangement for reinforcing poles that support one or more communication antennas to enable such poles to support additional antennas.

The present invention also relates to reinforced poles and retrofitted poles in particular, poles for supporting communication antennas.

BACKGROUND OF THE INVENTION

The growth of the wireless industry in the United States can be traced to the introduction of cellular service in the mid-1980's. The increase in mounting sites for wireless antennas is evidenced by the fact that in January 1985, there were only about 346 whereas in July 2000, there are approximately 82,000.

Wireless communication carriers use various structures to support their communication antennas at installation sites, for example, steel poles or towers. Steel poles are an aesthetic and increasingly popular self-standing structure utilized to support antennas for the wireless industry.

Steel poles designed, fabricated, and installed from 1985 through approximately 1996 were designed for singular usage, that is, each wireless carrier specified and purchased poles only capable of supporting their own antennas. However, as the wireless industry continued to grow through the addition of personal communications services (PCS) due to the auctioning of radio spectrum by the Federal Communications Commission in 1994, the demand for viable wireless sites exploded. Both cellular and PCS wireless service providers were competing for the ability to provide service to the public.

The public's perception and desire to stop pole and tower proliferation, strict zoning requirements, and competition for installation sites forced carriers to consider a new approach: co-location. Co-location is defined as having multiple carriers 'co-locate' or share, the same pole or tower. During 1997 and 1998, the wireless carriers began specifying and purchasing poles designed to provide multiple positions for installing wireless antennas. The carrier that purchased the pole would utilize one of the positions on the pole and the remaining positions would be leased to their competition in that area. Typically, at that time, poles would be designed for two to three carriers. However, as the industry continued to grow into the late 1990's, build-to-suit (BTS) companies began to have a presence in the wireless market place. BTS companies were not licensed wireless providers. Rather, they would own and operate the structures for the wireless carriers, in essence, acting as a landlord of the structures. As a result, the pressure to support additional wireless providers (co-locators) on existing structures continued to grow as the BTS companies strived to yield a return on their investment. In 2000, Lehman Brothers predicted build-to-suit tower requirements for co-location would increase from five wireless carriers per tower to seven wireless carriers per tower.

One problem facing the wireless industry in the face of increasing competition and public opposition to new wireless site construction is thousands of out-dated steel poles under-designed for the present needs of the industry. In other words, the industry must find a way to modify or retrofit thousands of existing steel poles from single or two carrier poles to poles capable of withstanding five to seven carriers.

Another problem that may arise is that poles might be manufactured with the expectation of supporting a set number of antennas but prior to installation, the number of antennas needed or desired for installation on the pole has increased so that the pole can no longer be used. Unless an alternative installation site is found which requires no more than the original set number of antennas, the pole has been rendered useless.

Another problem arises when it is desired to replace communication antennas with larger antennas. The pole as originally constructed might not be capable of supporting the increased area. In the prior art, there are several U.S. patents which describe arrangements for reinforcing poles and reinforced poles.

For example, U.S. Pat. No. 919,771 (Roberts) describes a pole including a central metal column, a base plate mounted on a concrete base, horizontal clamps and supporting rods or guys extending from the base plate through the clamps to a flange. The vertically extending supporting rods or guys are secured in the clamps between an annular rim and a securing ring.

U.S. Pat. No. 2,327,681 (Vanderveer) shows a pole reinforcement device including reinforcing members which are driven into the ground and clamping bands which clamp the reinforcing members to the pole.

U.S. Pat. No. 2,707,034 (Hetrick) shows a television mast stabilizer including a collar mounted around the mast and having a plurality of vertical elements that engage the mast to reinforce the mast.

U.S. Pat. No. 4,756,130 (Burtelson) shows an apparatus for reinforcing utility poles including a pair of collars mounted on the pole and having a splint therebetween which is driven into the ground.

U.S. Pat. No. 4,987,718 (Knight) shows a pole reinforcement system including a curved member and mounting holes. The member is driven into the ground adjacent the pole to be retrofitted and then attached via the mounting holes to the pole.

U.S. Pat. No. 6,108,996 (McGinnis) shows an apparatus for retrofitting guy-wired towers and includes a plurality of vertical legs which are designed to be attached outward of the existing legs.

None of these patents provides a reliable reinforcement system for a pole which is easily assembled and versatile.

OBJECTS AND SUMMARY OF THE INVENTION

It is an object of the present invention to provide a new and improved arrangement for reinforcing poles or retrofitting poles to increase their strength.

It is yet another object of the present invention to provide a new and improved arrangement for reinforcing poles that support one or more communication antennas to enable such poles to support additional antennas.

It is still another object of the present invention to provide a new and improved arrangement for reinforcing poles which is easily attached to an exterior of the pole.

It is yet another object of the present invention to provide new and improved reinforced pole for use, e.g., in supporting communication antennas.

In order to achieve the above objects, one embodiment of a reinforcement arrangement for a pole in accordance with the invention comprises a base flange adapted to surround a lower portion of the column and be attached to the base plate, elongate supports attached to the base flange at discrete locations around a circumference of the column and extend vertically alongside the column, and annular clamping collars adapted to be arranged around the column at different vertical locations. The clamping collars engage with the supports to thereby form a skeletal framework around the column.

Gussets may be connected to the base flange, descending downwardly and thus adapted to be connected to the base plate for supporting the base flange above the base plate.

The clamping collars may include an end clamping collar for clamping ends of the supports and which comprises a plurality of collar segments, each adapted to extend partially around the circumference of the column. Adjacent collar segments are attached to one another. Each collar segment comprises an inner wall adapted to conform to an adjacent portion of the column and an outer wall spaced from the inner wall to thereby define a space in which the ends of the supports are situated. The ends of the supports are attached to the inner and outer walls, e.g., by welding. A lowermost end of each support is attached to the base flange and an uppermost end of each support is attached to the end clamping collar.

Another clamping collar may be an intermediate clamping collar which is attached to intermediate portions of the supports. The intermediate clamping collar comprises a plurality of collar segments, each adapted to extend partially around the circumference of the column with adjacent collar segments being attached to one another. Each collar segment comprises a wall adapted to conform to an adjacent portion of the column. The intermediate portions of the supports are attached to the wall.

The supports usually comprise a tube. As used herein, the term "tube" is not limited to a hollow cylinder but encompasses any elongate hollow member having any cross-sectional shape. Indeed, in the art, tubes or a tubular structure is often used to refer to elongate, hollow steel members having a substantially rectangular or square cross-section. Solid elongate members are also encompassed by the use of the term "tube" herein.

One implementation of the reinforcement arrangement is designed for placement above the base plate in an intermediate location along the height of the pole and thus comprises two end clamping collars and supports extending therebetween. This embodiment does not use a base flange and associated gussets for supporting the base flange above the base plate.

Another embodiment of a reinforcement arrangement for a pole in accordance with the invention comprises elongate supports adapted to be attached to the base plate of the pole at discrete locations around a circumference of the column and extend vertically alongside the column and annular clamping collars adapted to be arranged around the column of the pole at different vertical locations. The clamping collars engage with the tubes to thereby form a skeletal framework around the column. This skeletal framework provides increased load-bearing capability to the pole which enables installation of additional antennas on the pole.

The supports may each comprise a gusset or stiffener member adapted to be fixed to the base plate and the column and one or more tubes with the lowermost tube being connected to the stiffener member.

The clamping collars generally comprise several collar segments, each extending partially around the circumference of the column with adjacent collar segments being attached to one another.

The clamping collars have several different forms depending on their placement relative to the tubes. One type of clamping collar is designed to secure ends of the supports, i.e., ends of the supports which are not attached to the base plate and column. In this clamping collar, a space is formed between inner and outer walls and the ends of the supports are situated therein and fixed to one or both of the walls. Another type is an intermediate clamping collar which is fixed to an intermediate portion of the supports. A third type is a splice clamping collar which is designed to provide a surface area to enable ends of vertically adjacent tubes to be fixed thereto.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE PREFERRED EMBODIMENTS

Figure 1:
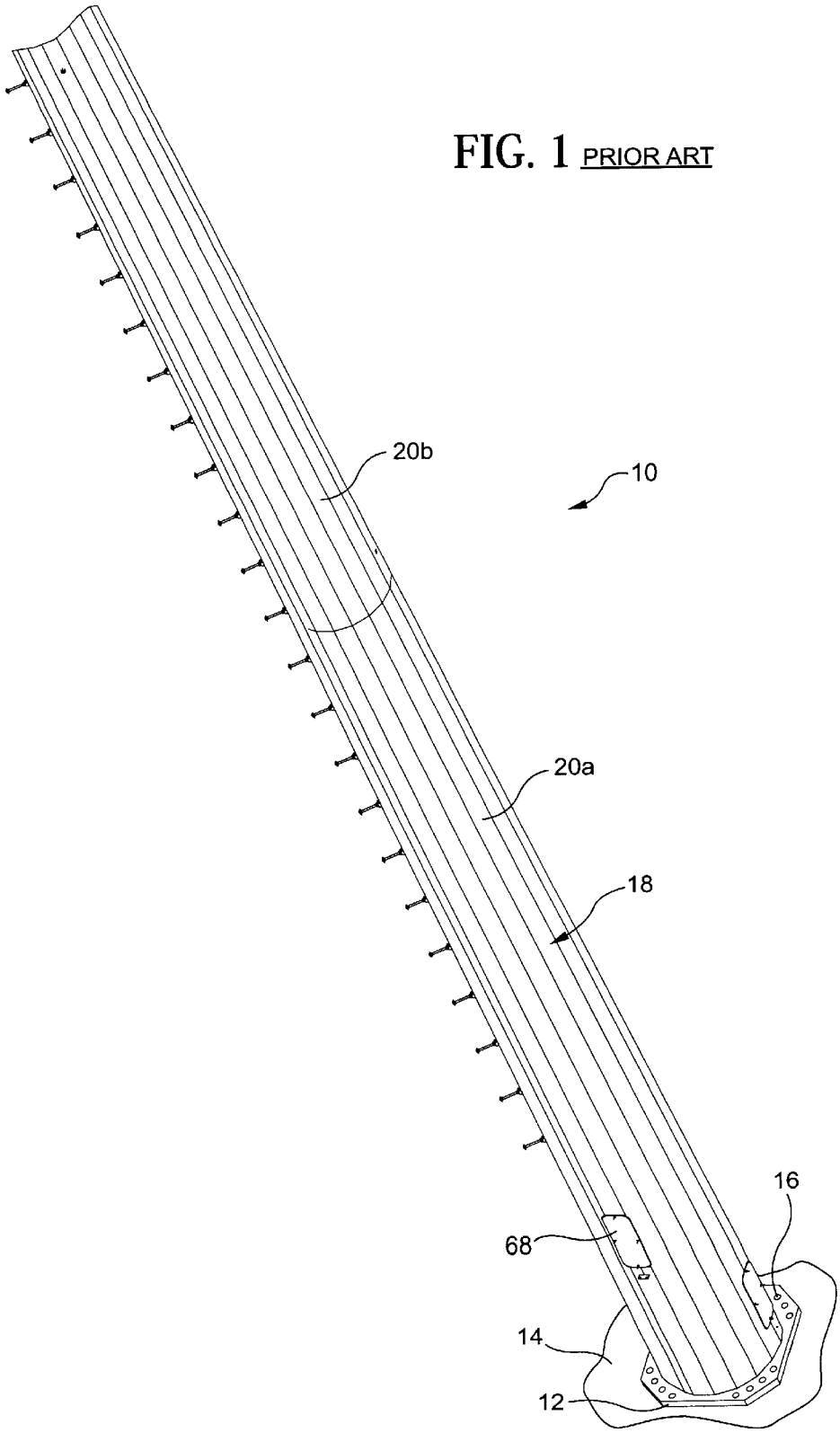
FIG. 1 PRIOR ART
FIG. 1 is a perspective view of a prior art pole to which the reinforcement arrangement in accordance with the invention can be applied.

Referring initially to FIG. 1, a typical pole for supporting wireless communication antennas currently in use (and which is often referred to as a monopole type of antenna supporting structure or monopole) is designated generally at 10 and includes a base plate 12 connected to a foundation 14 by anchor bolts or similar attachment means 16 and a column 18 connected to the base plate 12. Column 18 may comprise one or more segments, e.g. two segments 20*a*, 20*b* as shown in FIG. 1, and means for enabling attachment of one or more communication antennas (not shown). Additional equipment is also connected to the column 18, e.g., a support platform, or housed within the column 18, e.g., electronic communication devices.

As discussed above, a typical prior art monopole 10 was usually designed to support only a set of one or more antennas of a single communication provider. It is not assured that the monopole 10 would be capable of supporting multiple sets of antennas, i.e., antennas of multiple communication providers, since the load of such antennas would exceed the loading limit of the monopole. Therefore, there is a need to strengthen the monopole 10 in order to enable multiple sets of antennas to be connected thereto and thereby avoid the need to build an entirely new monopole.

Figure 2:
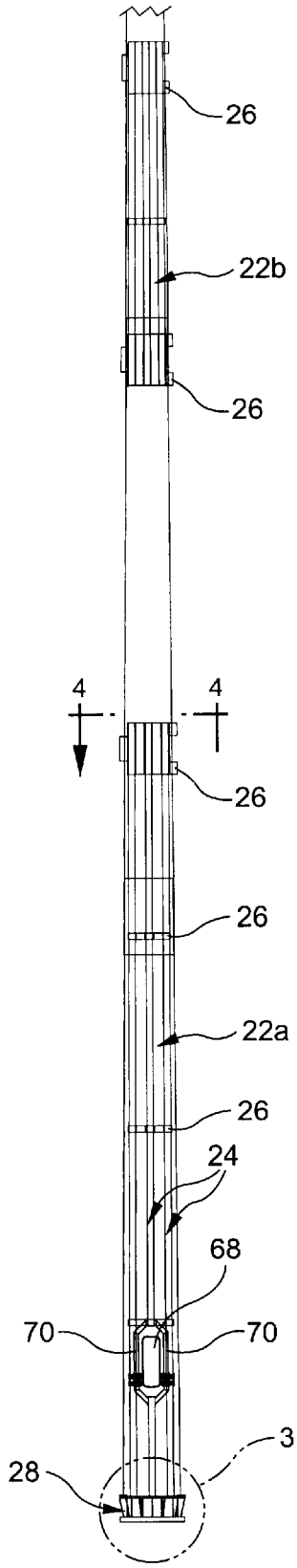
FIG. 2 is a perspective view of a pole including two embodiments of the reinforcement arrangement in accordance with the invention.

To this end, FIG. 2 shows two embodiments of a reinforcement arrangement 22*a*, 22*b* in accordance with the invention in connection with the prior art monopole 10. Each reinforcement arrangement 22*a*, 22*b* generally comprises a skeletal structure of cooperating vertical supports 24 and horizontal clamping collars 26 which together form an exoskeleton or skeletal framework about the column 18 of the monopole 10. The vertical supports 24 are spaced around the periphery of the column 18 whereas the horizontal clamping collars 26 surround the entire periphery of the column 18 at several vertical locations and engage the vertical supports 24.

A primary difference between the two reinforcement arrangements 22*a*, 22*b* is that the lower reinforcement arrangement 22*a* is designed to attach to the base plate 12 of the monopole 10 via an attachment arrangement 28 whereas the upper reinforcement arrangement 22*b* maybe positioned at any location along the monopole 10 and does not attach to the base plate 12.

Figure 3A:
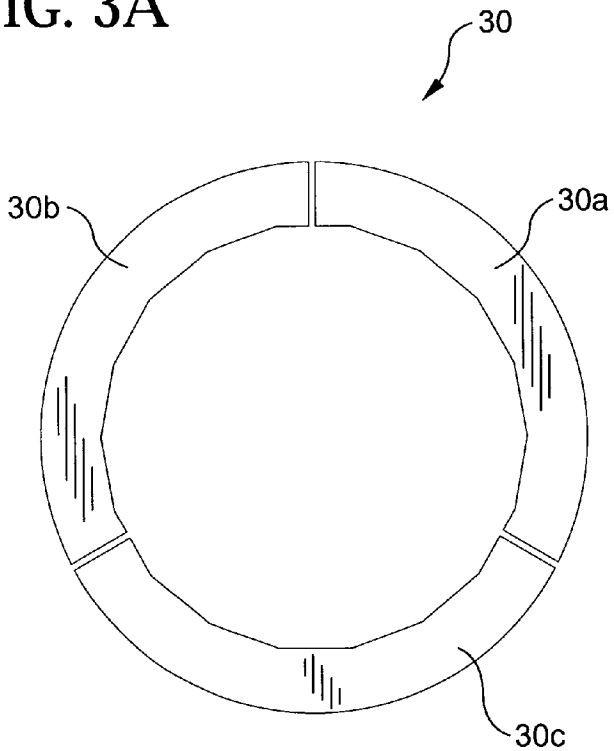
FIG. 3A is a view of the pieces of the base flange.
Figure 3:
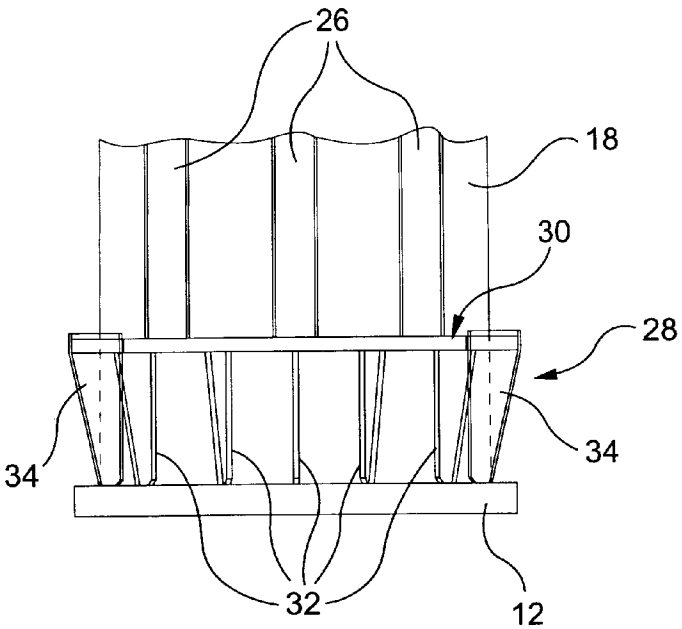
FIG. 3 is an enlarged view of the section designated 3 in FIG. 2.

The attachment arrangement 28 includes a base flange 30 and gussets 32, 34 descending downward from the base flange 30 (see FIG. 3). Base flange 30 is formed from an annular piece of rigid material such a steel with a polygonal interior periphery conforming to the polygonal outer periphery of the column 18 and cut into three pieces 30*a*, 30*b*, 30*c* (see FIG. 3A). The interior periphery of the base flange 30 has 18 sides in the illustrated embodiment and is cut at three locations so that each piece has five complete sides and the three pieces are substantially identical. In alternative embodiments the base flange can be round or multiple sided, i.e. 8, 10, 12, etc. The cutting of the base flange 30 into three pieces is designed to facilitate assembly of the lower section 22*a* by enabling fabrication of parts of the reinforcement arrangement 22*a* off-site at an assembly facility, as described in more detail below. Each part of the reinforcement arrangement 22*a* will include one of the pieces of the base flange 30.

Figure 3C:
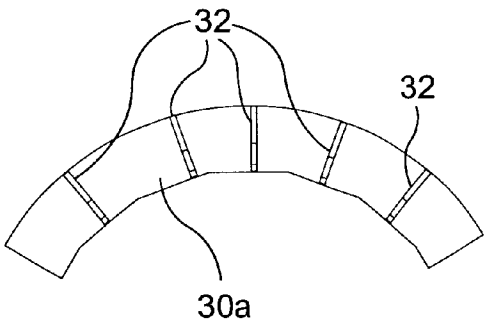
FIG. 3C is a bottom view of the flange piece shown in FIG. 3B.
Figure 3B:
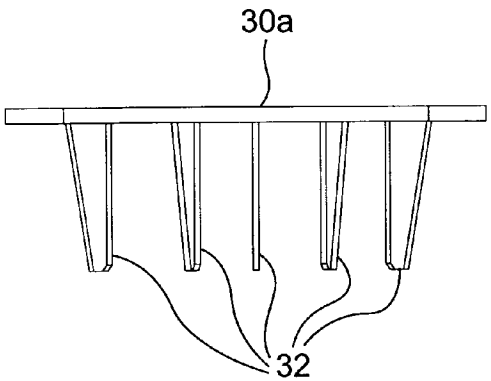
FIG. 3B is a front view of a first one of the flange pieces having gussets attached thereto.
Figure 3E:
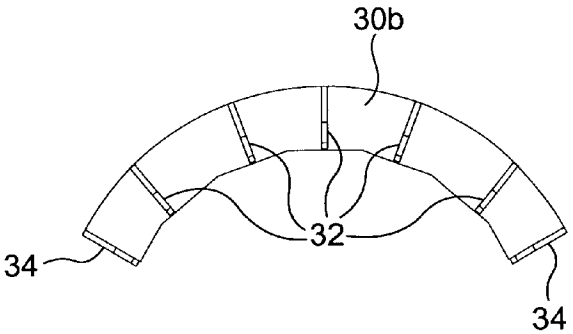
FIG. 3E is a bottom view of the flange piece shown in FIG. 3D.
Figure 3D:
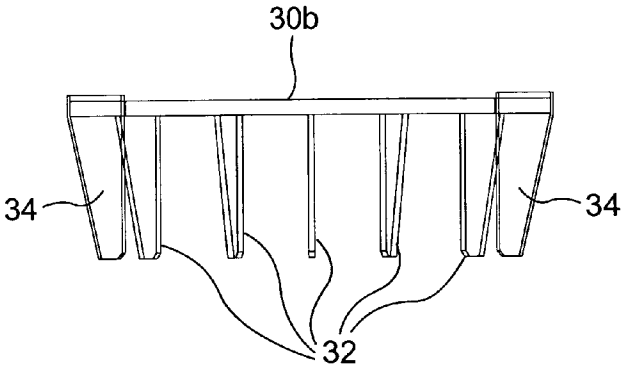
FIG. 3D is a front view of a second one of the flange pieces having gussets attached thereto.
Figure 3G:
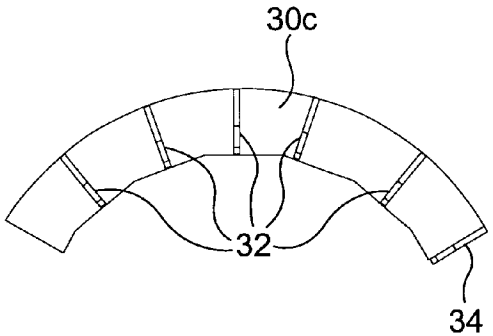
FIG. 3G is a bottom view of the flange piece shown in FIG. 3F.
Figure 3F:
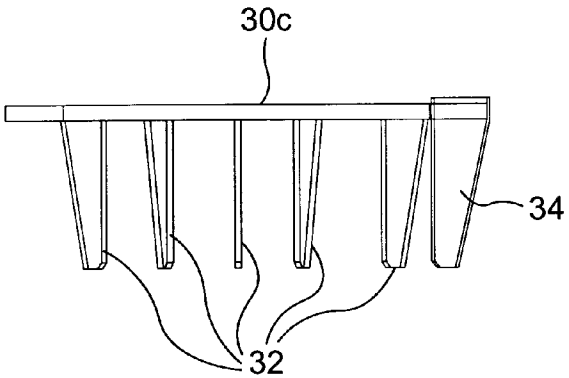
FIG. 3F is a front view of a third one of the flange pieces having gussets attached thereto.

Gussets 32, 34 are attached to the three pieces 30*a*, 30*b*, 30*c* of the base flange 30, typically by welding. Flange piece 30*a* has five gussets 32 attached thereto, each arranged perpendicular to a respective side of the polygonal interior periphery (see FIGS. 3B and 3C). Flange piece 30*b* has five gussets 32 attached thereto, each arranged perpendicular to a respective side of the polygonal interior periphery, and two gussets 34 arranged at its lateral edges (see FIGS. 3D and 3E). In some embodiments, gussets 34 are larger than gussets 32 and extending slightly above the upper surface of the flange piece 30*b*. However, the lower edge of the gussets 34 is aligned with the lower edge of gussets 32 so that flange piece 30*b* will lie evenly on the base plate 12. Flange piece 30*c* has five gussets 32 attached thereto, each arranged perpendicular to a respective side of the polygonal interior periphery, and one gusset 34 arranged at one lateral side (see FIGS. 3F and 3G). By providing three longer gussets 34 at the edges of the flanges pieces 30*b*, 30*c*, when the flange pieces 30*a*, 30*b*, 30*c* are brought together, a gusset 34 will be present between adjacent flange pieces and can be welded to thereto to form the base flange 30.

In alternative embodiments, gussets 34 are the same size as gussets 32. In these aspects of the invention, flange pieces 30*a*–30*c* are be butt welded together to form the integral base flange 30.

The provision of the base flange 30 and gussets 32, 34 is designed to enable the base flange 30 to be rotatable into multiple positions relative to the base plate 12 so that the gussets 32, 34 do not interfere with the anchor bolts securing the base plate 12 to a foundation. That is, an upper portion of the anchor bolts lies on the base plate 12 and would prevent a secure attachment of the gussets 32, 34 to the base plate 12, i.e., the planar lower edge of the gussets 32, 34 could not be welded to the base plate 12 as the anchor bolts would prevent total contact between the gussets 32, 34 and the base plate 12. As such, by providing the base flange 30 and gussets 32, 34, the base flange 30 can be rotated until the gussets 32, 34 do not overlie the anchor bolts and are in direct and complete contact with the upper surface of the base plate 12, i.e., to enable the gussets 32, 34 to be welded to the base plate 12.

The gussets 32, 34 have a front, angled surface and a rear, planar surface so that when installed, the rear, planar surface of each gusset 32, 34 is welded to the column 18.

Vertical supports 24 generally comprise elongate, hollow tubes or tubular structures 36 which in the illustrated embodiment, have a substantially square cross-section. It must be appreciated though that the exact form of the tubes 36 shown in the drawings is not intended to limit the invention.

Vertical supports 24 are placed at appropriate locations around the periphery of the column 18. The number of vertical supports 24 needed to reinforce the monopole 10 depends on the height of the column 18, the circumference of the column 18, the thickness of the column 18, the general structural strength of the column 18, the number of sides or whether it is round. Thus, the number of vertical supports 24 needed to reinforce a pole will vary depending on the construction of the pole. In a similar manner, the size and thickness of the tubes 36 can vary whereby of the same material, a thicker tube would provide a greater degree of reinforcement than a thinner tube. As such, any or all of the number of vertical supports 24, and size and thickness of the tube(s) 36 of each vertical support 24 can vary for each reinforcement arrangement in accordance with the invention.

In practice, an engineering evaluation would be performed on a pole to be retrofit with a reinforcement arrangement of the invention in accordance with the owner or carrier's specified loading requirements. This evaluation would determine how many vertical supports are needed, the required location of the vertical supports, and the thickness and size of the tubes of each vertical supports. Several alternative proposals would likely be determined. The evaluation would involve analysis of the existing loading capability of the pole and the desired loading capability in conjunction with the structure of the pole and the structure of the reinforcement arrangement in accordance with the invention.

In the embodiments shown in FIG. 2, there are two different types of clamping collars 26 used with both of the reinforcement arrangements 22*a*, 22*b*. One type is used to attach to ends of the vertical supports 24 and is referred to herein as an end clamping collar 38. Another type is used to attach to an intermediate portion of the tubes and is referred to herein as an intermediate clamping collar 40.

Figure 5:
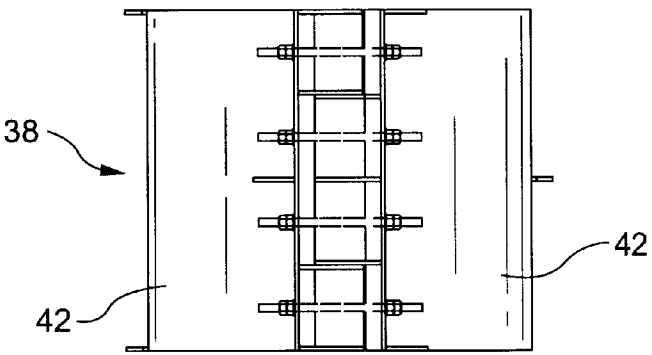
FIG. 5 is a side view of the assembled end clamping collar shown in FIG. 4.
Figure 4:
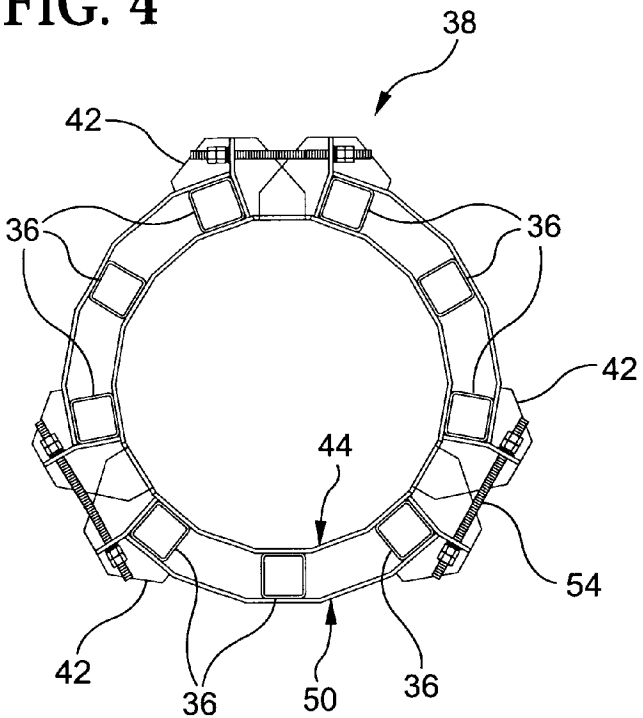
FIG. 4 is a top view of an assembled end clamping collar used in reinforcement arrangements in accordance with the invention.
Figure 5C:
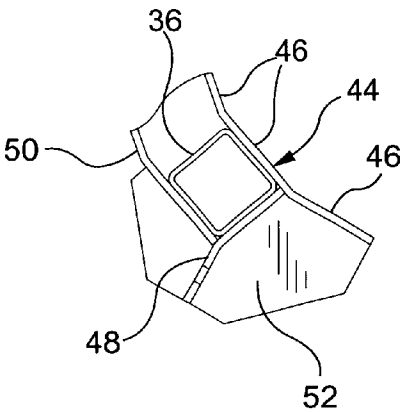
FIG. 5C is an enlarged view of the section designated 5C in FIG. 5A.
Figure 5B:
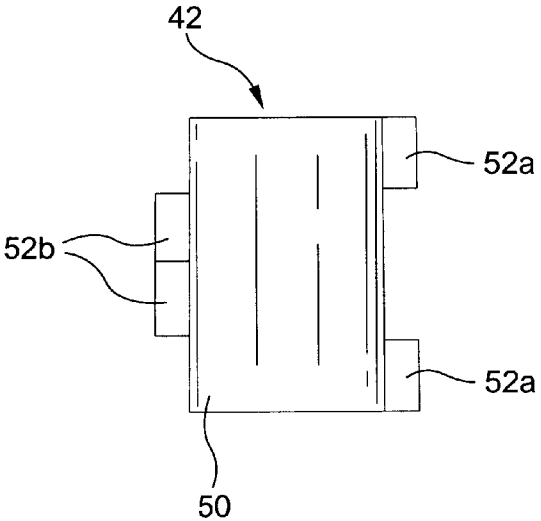
FIG. 5B is a front view of an end clamping collar section.

An end clamping collar 38 is shown in FIGS. 4–5C and is attached to the ends of the vertical supports 24. In the lower reinforcement arrangement 22*a*, one end clamping collar 38 is attached to the upper ends of the vertical supports 24 of the lower reinforcement arrangement 22*a*, and in the upper reinforcement arrangement 22*b*, one end clamping collar 38 is attached to the upper ends of the vertical supports 24 of the upper reinforcement arrangement 22*b* and another end clamping collar 38 is attached to the lower ends of the vertical supports 24.

Each end clamping collar 38 includes three collar sections 42, each designed to extend about 120 degrees around the circumference of the column 18. Each collar section 42 has an inner wall 44 having a contour substantially conforming to that portion of the cross-sectional shape of the column 18 against which the collar section 42 will abut. For the column 18 with planar sides, the inner wall 44 has a series of planar segments 46. End clamping collar sections 42 also include flanges 48 at the lateral edges of the inner wall 44 and an outer wall 50 which overlies the ends of the tubes 36 of the vertical supports 24. Outer wall 50 is designed to have planar portions in contact with the tubes 36 and may, as in the illustrated embodiment, have the same form as the inner wall 44, i.e., have the same number of planar segments, each of which is parallel to a respective planar segment 46 of the inner wall 44.

Attachment flanges or flanges 52 are formed in connection with or as part of the inner wall and/or flanges 48 to facilitate attachment of adjacent end clamping collar sections 42 together during installation of the reinforcement arrangements 22*a*, 22*b*. More specifically, at one end of the collar section 42, an attachment flange 52*a* is positioned along each of the upper and lower edges of the collar section 42 and at the opposite end, two attachment flanges 52*b* are positioned in an intermediate location, which when adjacent collar sections 42 are placed adjacent one another, will result in the two intermediate attachment flanges 52*b* being sandwiched between the edge attachment flanges 52*a* along the upper and lower edges (see FIG. 5). Thereafter, threaded rods 54 are inserted through apertures in the flanges 48 over the attachment flanges 52 and the collar sections 42 secured to one another by threading nuts onto the ends of the threaded rods 54. Other means for attaching the end clamping collar sections 42 together are also within the purview of the invention.

End clamping collar sections 42 are not required to be fixedly connected to the column 18. Rather, the collar sections 42 are clamped to one another to form the end clamping collar 38 with such clamping serving to fix the end clamping collar 38 to the column 18 at a desired vertical height. Nevertheless, it is possible to fix the collar sections 42 to the column 18, e.g., by welding bolting or screws.

Figure 5A:
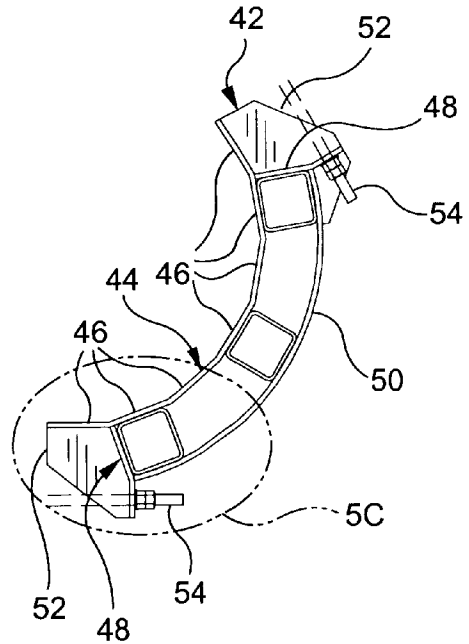
FIG. 5A is a top view of an end clamping collar section as it appears in the assembled end clamping collar shown in FIG. 4.

In use, the ends of the tubes 36 will be welded to the inner wall 44 and then the outer wall 50 welded to the ends of the tubes 36 to thereby secure the ends of these tubes 36 between the inner and outer walls 44, 50 as shown in FIGS. 4, 5A and 5D.

Figure 6A:
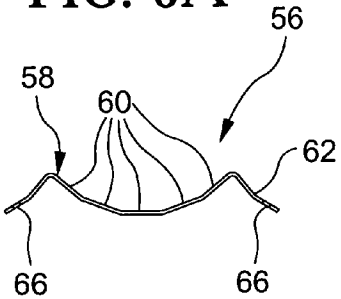
FIG. 6A is a front view of an intermediate clamping collar section.
Figure 6B:
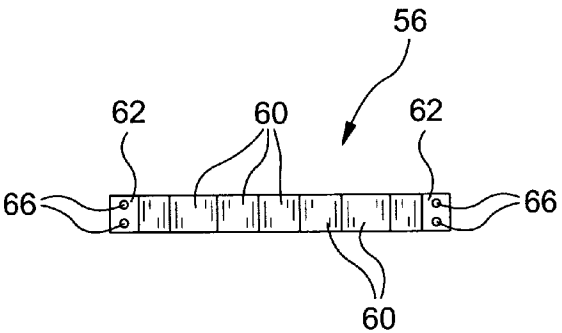
FIG. 6B is a top view of an intermediate clamping collar section.
Figure 6:
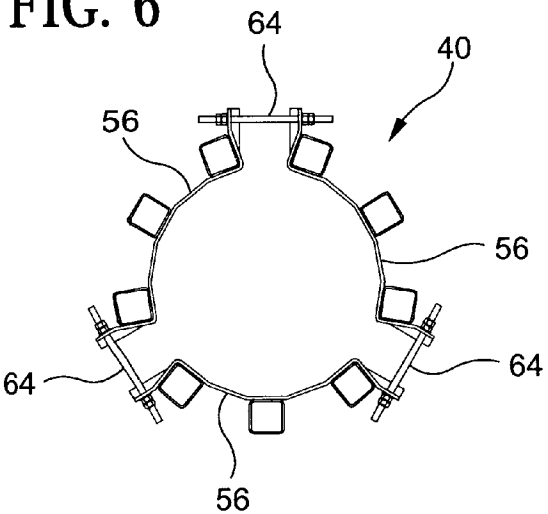
FIG. 6 is a view of an assembled intermediate clamping collar used in reinforcement arrangements in accordance with the invention.

An intermediate clamping collar 40 is shown in FIG. 6 and is attached to intermediate portions of the tubes 36 of each vertical support 24. Intermediate clamping collar 40 includes three collar sections 56, each designed to extend about 120 degrees around the circumference of the column 18. As shown in FIGS. 6A and 6B, each collar section 56 has a wall 58 having a contour conforming to the cross-sectional shape of that portion of the column 18 against which the wall 58 will abut. For the column 18 with planar sides, the wall 58 has a series of planar segments 60. Intermediate clamping collar sections 56 includes flanges 62 at the lateral edges of the wall 58 to facilitate attachment of adjacent collar sections 56 together. Flanges 62 may be formed in connection with or as part of the wall 58.

To secure the clamping collar sections 56 together, threaded rods 64 are inserted through apertures 66 in the flanges 62 and the collar sections 56 secured to one another by threading nuts onto the ends of the threaded rods 64. Other means for attaching the collar sections 56 together are also within the purview of the invention.

Intermediate clamping collar sections 56 are not required to be fixedly connected to the column 18. Rather, the collar sections 56 are clamped to one another to form the intermediate clamping collar 40 with such clamping serving to fix the intermediate clamping collar 40 to the column 18 at a desired vertical height. In use, the tubes 36 will be welded to the wall 58 as shown in FIG. 6.

In conventional monopoles, including the one shown in FIG. 1, one or more access ports 68 are usually provided. To enable continued access to the port(s) 68 after installation of the reinforcement arrangement 22*a*, certain accommodations must be made. In the illustrated embodiment, these accommodations entail providing bypass tubes on either side of the column 18 around the access ports 68.

As shown in FIG. 2, two bypass tubes 70 are arranged one on each side of the access port 68. Each tube 68 is separated into two parts 72, 74 which are connected together upon installation of the reinforcement arrangement 22*a* (see FIG. 9). To bypass the access port 68, a shorter tube 36*a* is connected to the base flange 30 and leads to a location below the access port 68 where tube parts 72 extend in opposite directions to the sides of the access port 68. From the end clamping collar 38, a longer tube 36*b* descends to a location above the access port 68 where tube parts 74 extend in opposite directions to the sides of the access port 68. Tube parts 72, 74 on each side of the access port 68 are connected by bolts and splice plates, and the tube parts 72, 74 are welded to the respective tube 36*a*, 36*b* or to intermediate gussets 80. This bypass arrangement maybe used for any access ports on the column 18 and the size of tubes 36*a*, 36*b* may be varied based on the height of the access port.

When assembling the reinforcement arrangements 22*a*, 22*b*, it is usually desirable to assemble as many components as possible off-site and bring the sub-assemblies to the monopole 10 for installation. It is of course possible to bring the individual parts of the reinforcement arrangement to the site of the monopole and perform the entire assembly procedure on site.

Accordingly, several sub-assemblies of each of the lower reinforcement arrangement 22*a* and the upper reinforcement arrangement 22*b* are formed and connected together only upon attachment to the monopole.

Figure 7:
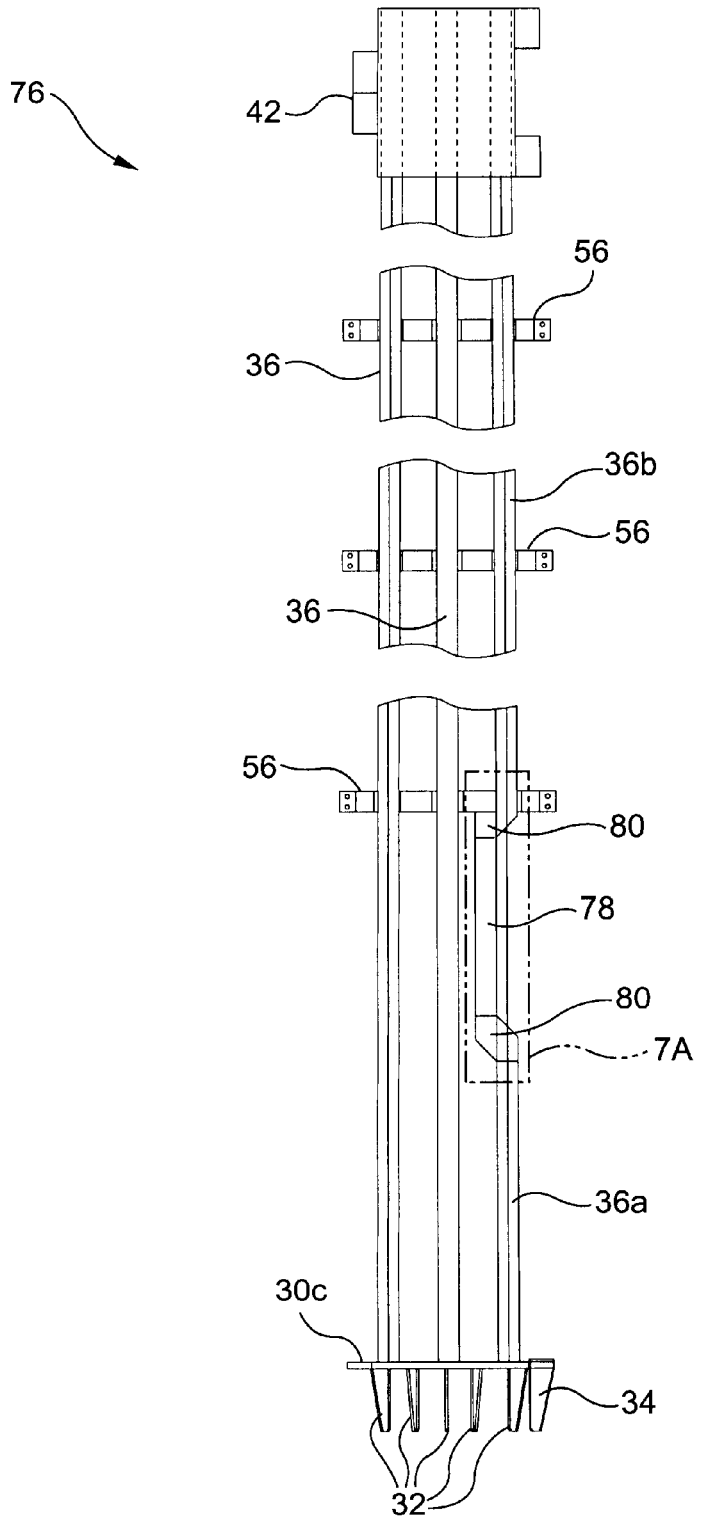
FIG. 7 is a front view of a first sub-assembly of a reinforcement arrangement shown in FIG. 2.
Figure 7A:
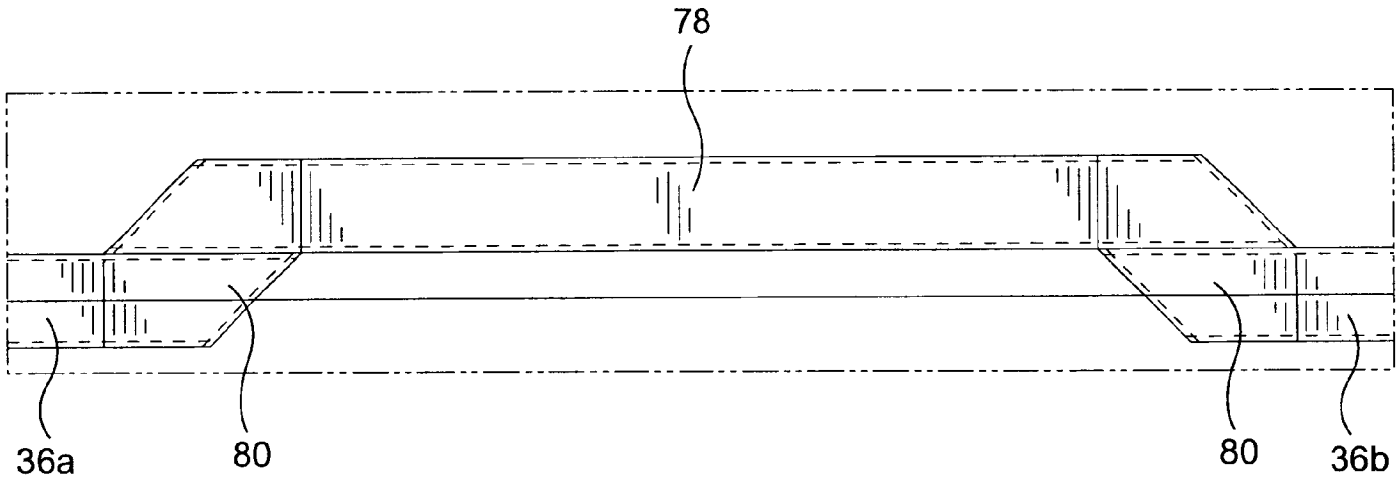
FIG. 7A is an enlarged view of the section designated 7A in FIG. 7.

With respect to the lower reinforcement arrangement 22*a*, a first sub-assembly 76 is shown in FIG. 7. This sub-assembly 76 comprises flange piece 30*c*, five gussets 32, one gusset 34, two tubes 36, three intermediate clamping collar sections 56 and one end clamping collar section 42 and a bypass arrangement comprising a short tube 36*a*, a long tube 36*b*, a bypass tube 78 and gussets 80 for connecting the bypass tube 78 to the short and long tubes 36*a*, 36*b* (see FIG. 10A). Gussets 80 are arranged on both sides of the bypass tube 78. Short and long tubes 36*a*, 36*b* are aligned with each other and bypass tube 78 is offset from short and long tubes 36*a*, 36*b*.

To assemble sub-assembly 76, gussets 32, 34 are welded to the flange piece 30*c* and tubes 36 and short tube 36*a* are welded to the upper surface of the flange piece 30*c* with each tube preferably in alignment with the center of a side of the interior periphery of the flange piece 30*c*. Tubes 36 and long tube 36*b* are also welded to the outer surface of the wall 58 of the intermediate clamping collar sections 56 at set heights, with the tubes 36 adjacent the flanges 62 also being welded thereto.

In the illustrated embodiment, the length of the reinforcement arrangement 22*a* is about 40' with the intermediate clamping collar sections 56 being arranged at heights of about 9', 19' and 29' from the flange piece 30*c*. Generally, the intermediate clamping collar sections 56 are placed at equal intervals to provide beneficial strength to the reinforcement arrangement 22*a*, although analysis may result in a determination of uneven spacing between intermediate clamping collar sections 56. The ends of the tubes 36 and long tube 36*b* are also welded to the outer surface of the inner wall 44 of the end clamping collar section 42, and to the flanges 48 if adjacent thereto, and then the outer wall 50 is placed over the ends of the tubes 36 and long tube 36*b* and welded thereto and to the flange 48. The gussets 80 are then welded to the bypass tube 78 and to the upper end of the short tube 36*a* and the lower end of the long tube 36*b*.

Figure 8:
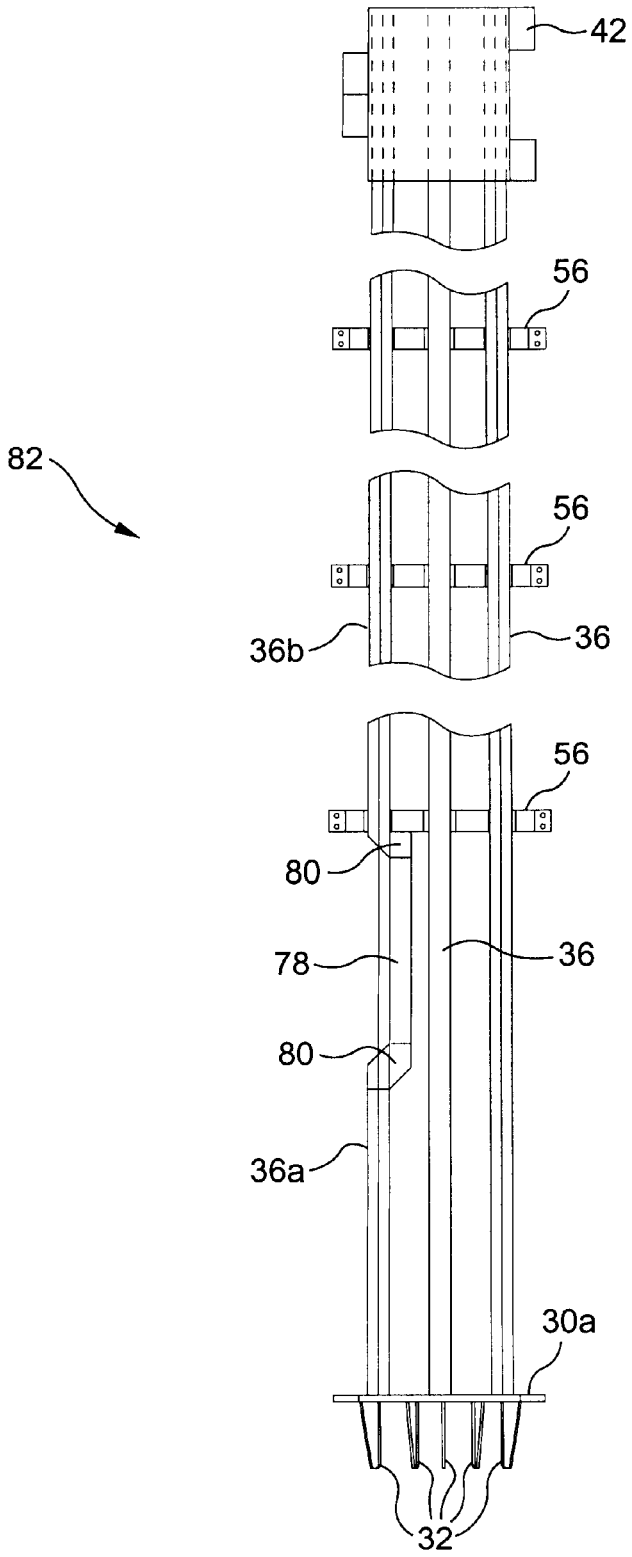
FIG. 8 is a front view of a second sub-assembly of a reinforcement arrangement shown in FIG. 2.

A second sub-assembly 82 of the lower reinforcement arrangement 22*a* is shown in FIG. 8. This sub-assembly 82 comprises flange piece 30*a*, five gussets 32, two tubes 36, three intermediate clamping collar sections 56 and one end clamping collar section 42 and a bypass arrangement comprising a short tube 36*a*, a long tube 36*b*, a bypass tube 78 and gussets 80 for connecting the bypass tube 78 to the short and long tubes 36*a*, 36*b*. Gussets 80 are arranged on both sides of the bypass tube 78. Short and long tubes 36*a*, 36*b* are aligned with each other and bypass tube 78 is offset from short and long tubes 36*a*, 36*b*.

To assemble sub-assembly 82, gussets 32 are welded to the flange piece 30*a* and tubes 36 and short tube 36*a* are welded to the upper surface of the flange piece 30*a* with each tube preferably in alignment with the center of a side of the interior periphery of the flange piece 30*a*. Tubes 36 and long tube 36*b* are welded to the outer surface of the inner wall 58 of the intermediate clamping collar sections 56 at set heights (the same heights as for the other sub-assemblies), with the tubes 36 adjacent the flanges 62 being welded thereto. The ends of the tubes 36 and long tube 36*b* are also welded to the outer surface of the inner wall 44 of the end clamping collar section 42, and to the flanges 48 if adjacent thereto, and then the outer wall 50 is placed over the ends of the tubes 26 and long tube 26*b* and welded thereto and to the flange 48. The gussets 80 are then welded to the bypass tube 78 and to the upper end of the short tube 36*a* and the lower end of the long tube 36*b*.

Figure 9:
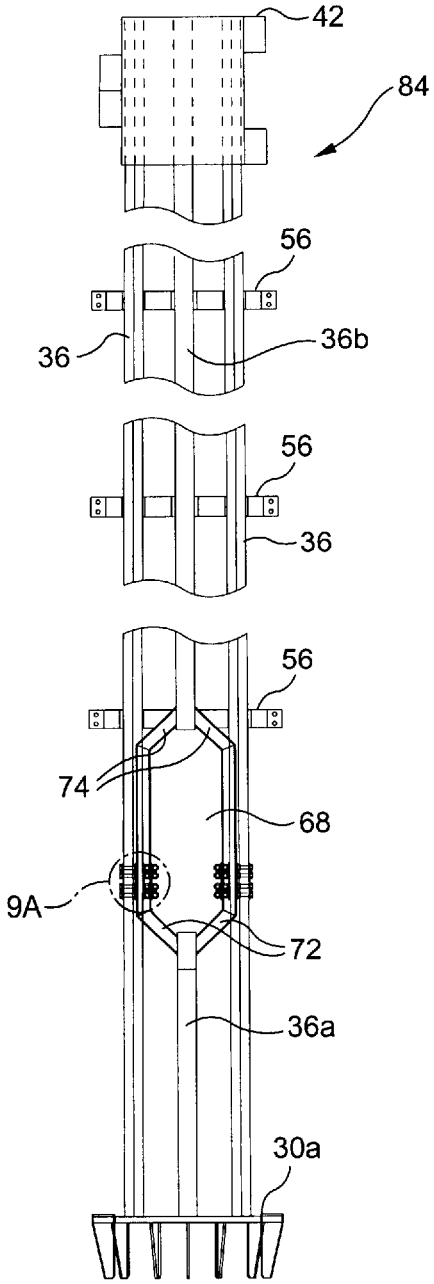
FIG. 9 is a front view of a third sub-assembly of a reinforcement arrangement shown in FIG. 2.

A third sub-assembly 84 of the lower reinforcement arrangement 22*a* is shown in FIG. 9. This sub-assembly 84 comprises flange piece 30*b*, five gussets 32, two gussets 34, two tubes 36, three intermediate clamping collar sections 56 and one end clamping collar section 42 and a bypass arrangement comprising a short tube 36*a*, a long tube 36*b*, two bypass tubes 70 and splice plates 86 for connecting separated portions of the tubes 70 together (these separated portions being designated as tube parts 72, 74). Short and long tubes 36*a*, 36*b* are aligned with each other and bypass tubes 70 are offset from short and long tubes 36*a*, 36*b*.

To assemble sub-assembly 84, gussets 32, 34 are welded to the flange piece 30*b* and tubes 36 and short tube 26*a* are welded to the upper surface of the flange piece 30*b* with each tube preferably in alignment with the center of a side of the interior periphery of the flange piece 30*b*. Tubes 36 and long tube 36*b* are welded to the outer surface of the inner wall 58 of the intermediate clamping collar sections 56 at set heights (the same heights as for the other sub-assemblies), and the ends of the tubes 36 and long tube 36*b* are welded to the inner wall 44 of the end clamping collar section 42, and flanges 48 if adjacent thereto, and then the outer wall 50 is welded to the ends of the tubes 36 and long tube 36*b* and flange 48.

Figure 9A:
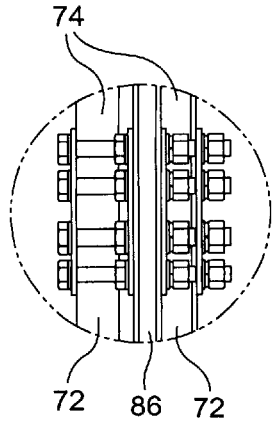
FIG. 9A is an exploded view of the section designated 9A in FIG. 9.

To enable attachment of the sub-assembly 84 to the monopole, the sub-assembly is cut in the area of the bypass tubes 70 to thereby separate the sub-assembly 82 into two parts. The splice plates 86 are used to connect the parts 72, 74 of the bypass tubes 70 together when the sub-assembly 84 is reconnected on site (see FIG. 9A). Splice plates 86 are also used to re-connect the parts of the tubes 36 together on site.

Accordingly, a kit of the reinforcement arrangement 22*a* would comprise sub-assembly 76, sub-assembly 82 and the two parts of sub-assembly 84 with the associated splice plates 86. This kit could be easily assembled at a factory site and transported to the location of the monopole.

At the site of the monopole, the sub-assemblies 76 and 82 are attached to the pole, and the two parts of sub-assembly 84 are attached to the pole and then, using the splice plates 86, attached to one another. Threaded rods 54, 64 are then inserted through the apertures in the adjacent flanges on the intermediate clamping collar sections 56 and the adjacent end clamping collar sections 42 and nuts used to clamp the collar sections 42, 56 together and thereby form the intermediate clamping collars 40 and the end clamping collar 38. The gussets 32, 34 are welded to the base plate 12 and column 18.

Figure 10:
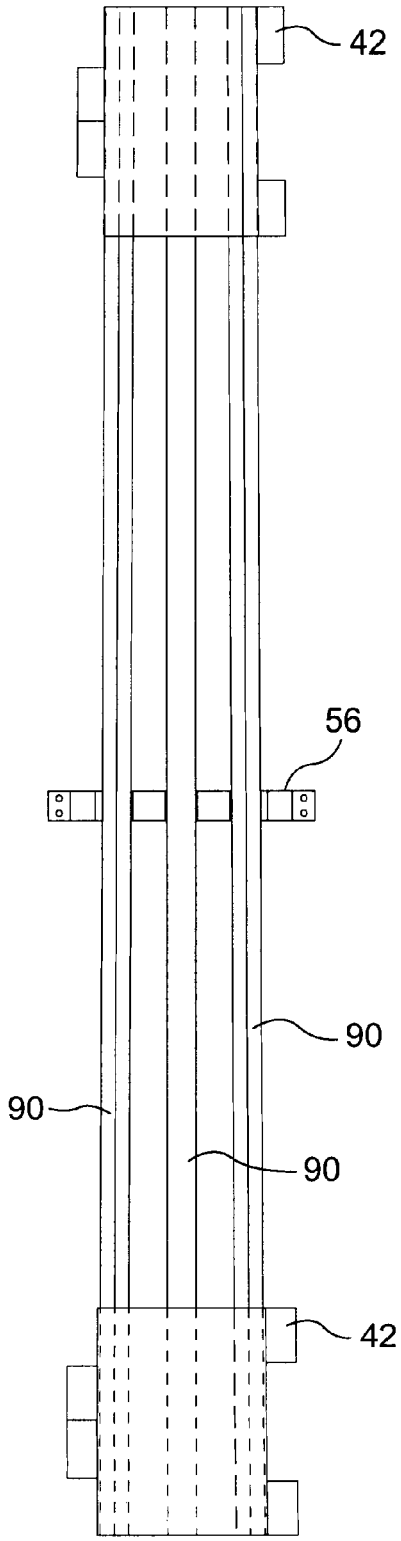
FIG. 10 is a front view of a sub-assembly of another reinforcement arrangement shown in FIG. 2.

With respect to the upper reinforcement arrangement 22*b*, since there is no access port covered thereby and it does not require attachment to a base plate, the upper reinforcement arrangement 22*b* is made of three substantially identical sub-assemblies 88 shown in FIG. 10.

Each sub-assembly 88 comprises three tubes 90 of equal length, one intermediate clamping collar section 56 and two end clamping collar sections 42. To assemble sub-assembly 88, ends of the tubes 90 are welded to the inner wall 44 of the end clamping collar sections 42 and a middle portion of the tubes 90 is welded to the outer surface of the intermediate clamping collar section 56. The outer walls 50 of the end clamping collar sections 42 are then welded over the tubes 90. In the illustrated embodiment, the intermediate clamping collar section 56 is preferably situated equidistant from the edges of the tubes 90.

Accordingly, a kit of the reinforcement arrangement 22*b* would comprise three sub-assemblies 88. This kit could be easily assembled at a factory site and transported to the location of the monopole for installation in connection therewith.

At the site of the monopole, the sub-assemblies 88 are attached to the pole and then threaded rods 54, 64 are inserted through the apertures in the adjacent flanges on the intermediate clamping collar sections 56 and the adjacent end clamping collar sections 42 and nuts used to clamp the collar sections 42, 56 together and thereby form the intermediate clamping collar 40 and the end clamping collars 38.

As to preferred dimensions of the clamping collars 38 and 40, the end clamping collar 38 is taller than the intermediate clamping collar 40 and has a height of about 32". The intermediate clamping collar has a height of only about 4". The attachment flanges 52 of end clamping collar sections 42 have a height of about 8" when four attachment flanges 52 are provided, as in the illustrated embodiment. As such, adjacent attachment flanges 52 from adjacent collar sections 42 will contact one another and create a tight fit between adjacent collar sections 42.

Figure 11:
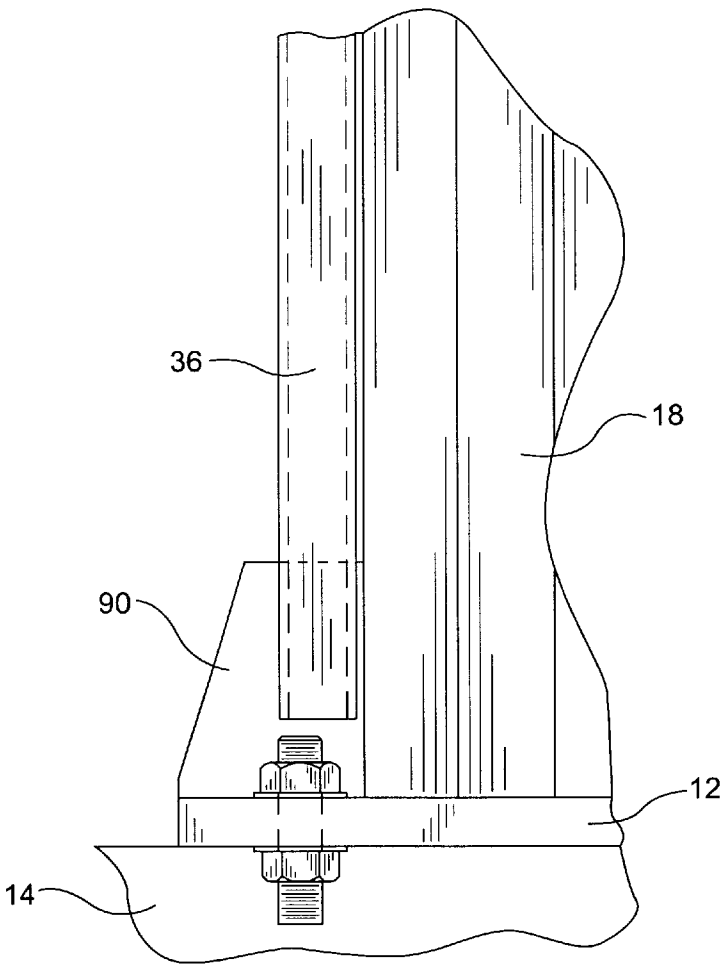
FIG. 11 is a view of an alternative arrangement for attaching supports to a base plate.

In another embodiment of the invention, instead of using abase flange 30, the vertical supports 24 can comprise a gusset or stiffener 90 attached to each tube 36 (as shown in FIG. 11). Gusset 90 is in the form of a rigid plate and has a lower edge attached to the base plate 12 and a side edge attached to the column 18. The lowermost tubes 36 are then provided with a longitudinal slot into which the gusset 90 is slid and then the gusset 90 is attached to the lowermost tube by, e.g., welding. The longitudinal slot has a length less than the height of the gusset 90 so that the lowermost tube does not extend to the base plate 12 and thus does not contact the anchor bolts which secure the base pate 12 to the foundation 14.

Since it may often be the case that tubes 36 capable of easy transport cannot extend the entire length of the reinforcement arrangement, e.g., a reinforcement arrangement extending 90' is necessary but 90' poles cannot be easily transported, in another embodiment of the invention, splice clamping collars are used. A splice clamping collar is used to splice vertically adjacent tubes together.

Figure 13:
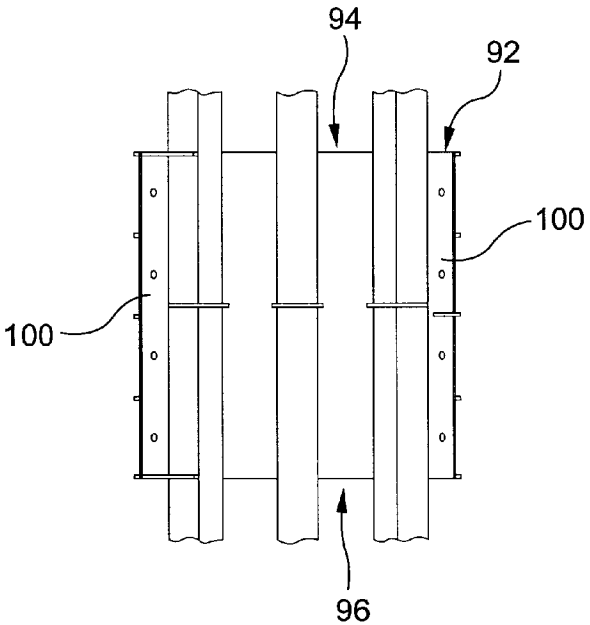
FIG. 13 is a side view of the clamping collar section of the assembled splice clamping collar shown in FIG. 12.
Figure 12:
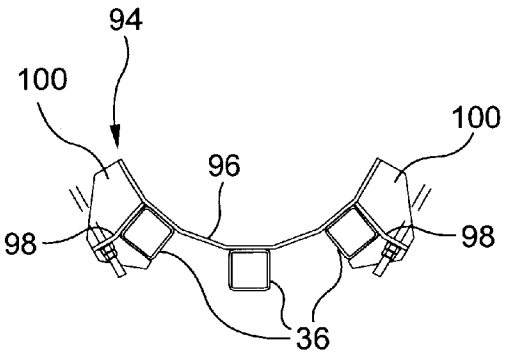
FIG. 12 is a top view of a clamping collar section of an assembled splice clamping collar for use in a reinforcement arrangement in accordance with the invention.
Figure 14:
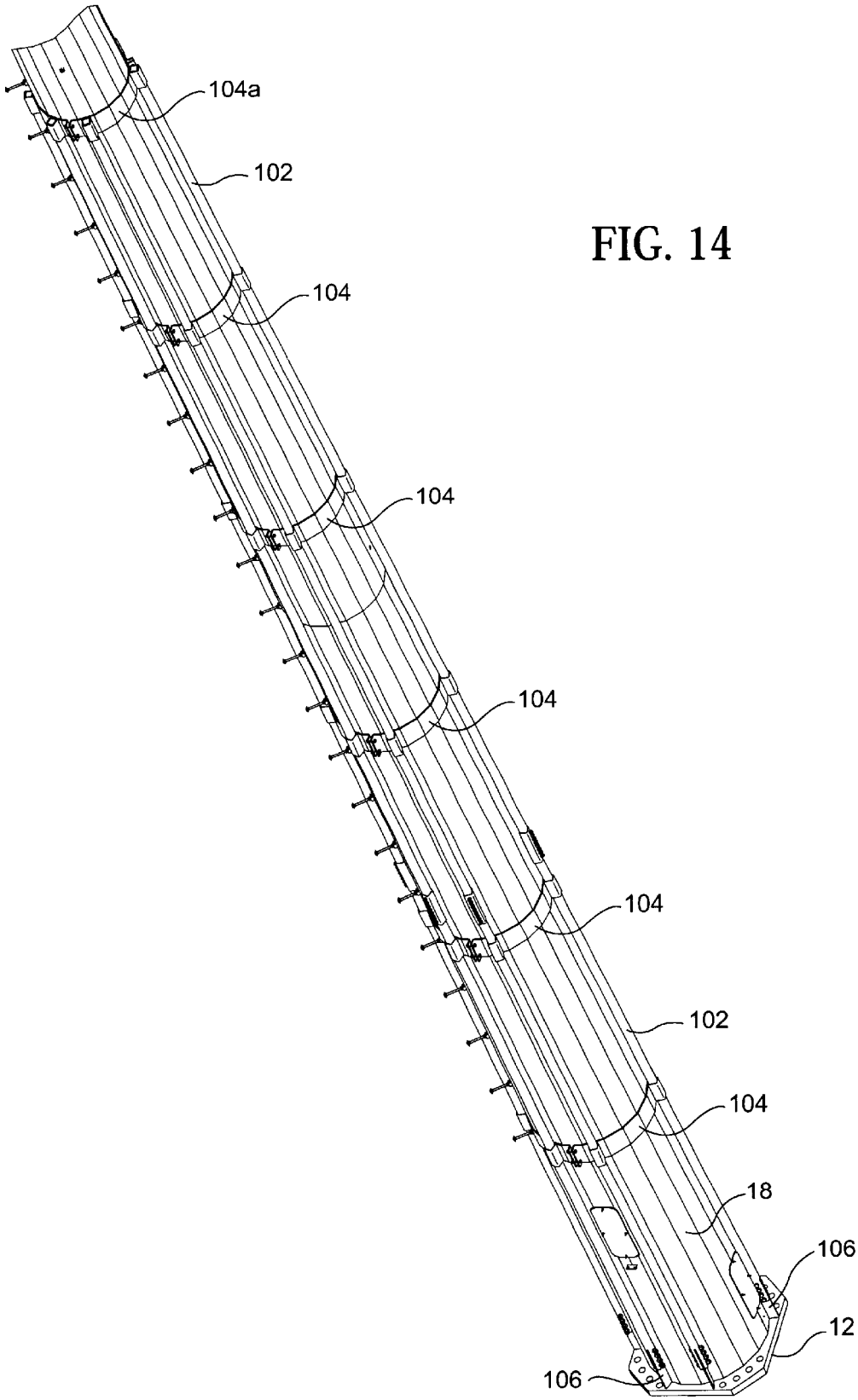
FIG. 14 is a perspective view of a pole including a second embodiment of the reinforcement arrangement in accordance with the invention.
Figure 15:
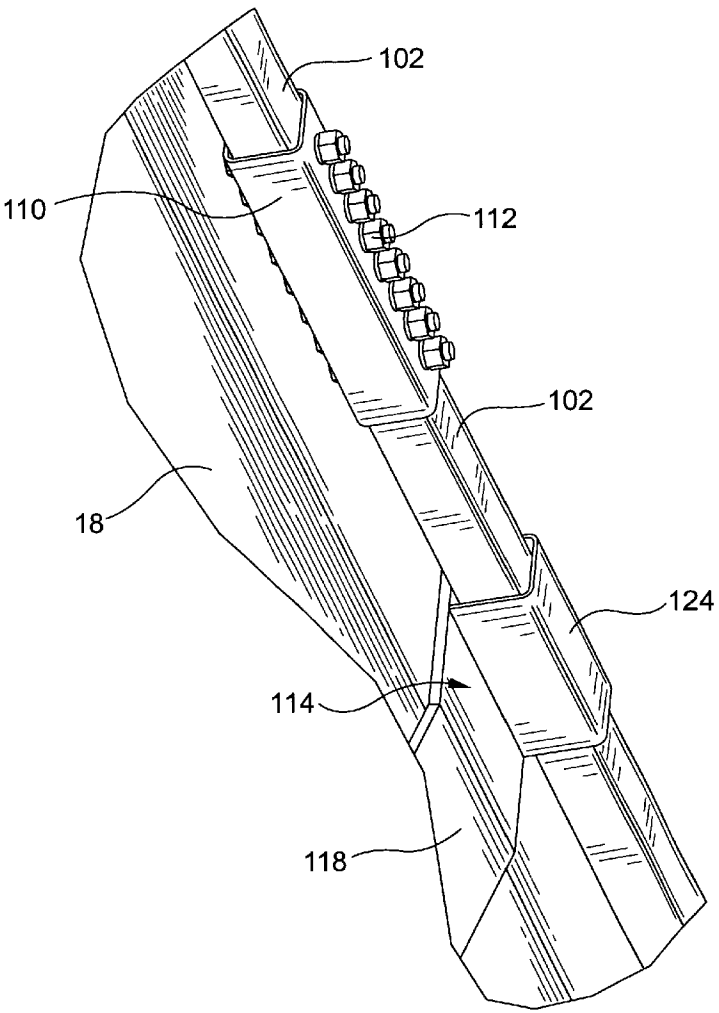
FIG. 15 is a perspective view of the splicing of vertically adjacent tubes of a support in the embodiment shown in FIG. 14.
Figure 16:
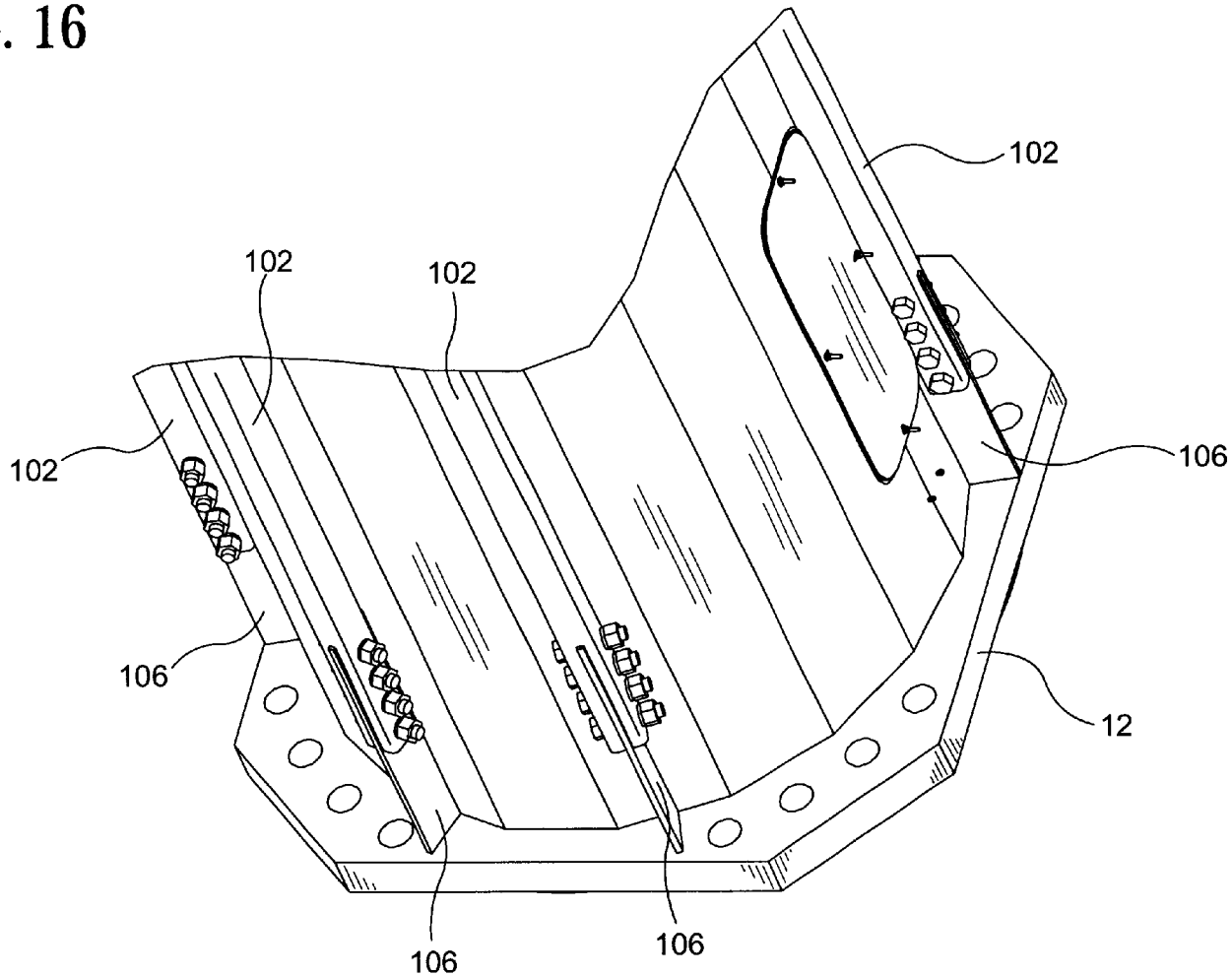
FIG. 16 is a perspective view of the bottom of the pole shown in FIG. 14.

A splice clamping collar 92 is shown in FIGS. 12 and 13 and is attached to ends of vertically adjacent tubes 36 when two or more tubes form a vertical support 24. When a vertical support 24 consists of a single tube, a splice clamping collar is not required.

Splice clamping collar 92 includes three collar sections 94, each designed to extend about 120 degrees around the circumference of the column 18. Each collar section 94 has an wall 96 having a contour conforming to the shape of that portion of the column 18 which the wall 96 will abut. For the column 18 with planar sides, the wall 96 has a series of planar segments. Splice clamping collar sections 94 also includes flanges 98 at the lateral edges of the wall 96 to facilitate attachment of adjacent collar sections 94 together.

Attachment flanges or fingers 100 are formed in connection with or as part of the wall 96 and/or flanges 98 to facilitate attachment of adjacent splice clamping collar sections 94 together during installation of the reinforcement arrangements. Attachment flanges 100 are similar to attachment flanges 52*a* and 52*b* discussed above with reference to the end clamping collar sections 42. Thus, threaded rods are inserted through apertures in the flanges 100 and the collar sections 94 secured to one another by threading nuts onto the ends of the threaded rods 100. Other means for attaching the collar sections 94 together are also within the purview of the invention.

As shown in FIG. 13, an upper end of each lower tube 36 is attached, e.g., by welding, to an outer surface of the wall 96 of a collar section 94 from the approximate horizontal mid-point of the wall 96 to the lower edge of the collar section 94. A lower end of each upper tube 36 is attached to the outer surface of wall 96 from the approximate mid-point to the upper edge of the collar section 94 with the lower edge of the upper tubes 36 being in contact with the upper edge of a respective one of the lower tubes 36. This contact is facilitated by welding aligning pairs of tubes 36 together.

As with the end clamping collar 38, the collar sections 94 of the splice clamping collar 92 are not fixedly connected to the column 18. Rather, the collar sections 94 are clamped to one another with such clamping serving to fix the clamping collar 92 to the column 18 at a desired vertical height.

As to preferred dimensions of the splice clamping collar 92, the splice clamping collar 92 is preferably taller than the intermediate clamping collar 40 and has a height of about 32". The attachment flanges 100 on collar sections 94 have a height of about 8" when four attachment flanges 100 are provided. As such, adjacent attachment flanges 100 from adjacent collar sections 94 will contact one another and create a tight fit between adjacent collar sections 94.

The number and location of clamping collars 38, 40 and 92 used for reinforcing a pole depends, among other things, on the height of the pole and the additional desired loading capability. For example, for a pole longer than 90', a preferred construction of the reinforcement arrangement could comprises a single end clamping collar 38 arranged at a height of 90', two splice clamping collars 92, one arranged at a height of 30' and the other arranged at a height of 60', and seven intermediate clamping collars 40. Three intermediate collars 40 are arranged between the base plate 12 and the splice clamping collar 92 at a height of 30' approximate at equally spaced intervals, two intermediate collars 40 are arranged between the splice clamping collar 92 at a height of 30' and the splice clamping collar 92 at a height of 60' approximate at equally spaced intervals and two intermediate collars 40 are arranged between the splice clamping collar 92 at a height of 60' and the end clamping collar 38 approximate at equally spaced intervals. In this construction, each vertical support 24 would comprise three 30' tubes 36, with the lowermost tube extending from the base flange 30 to the splice clamping collar 92 at a height of 30', the intermediate tube extending from the splice clamping collar 92 at a height of 30' to the splice clamping collar at a height of 60' and the uppermost tube extending from the splice clamping collar 92 at a height of 60' to the end clamping collar 38. Note that the height of the lowermost tubes would be somewhat less than 30' as it would not extend from the base plate 12 but rather would extend from the base flange 30 which is at a height of about 1' from the base plate 12.

If only 60' of reinforcement of a pole was needed, then only a single splice clamping collar 92 would be used at a height of 30' and the end clamping collar would be positioned at a height of 60'. The vertical supports 24 would thus comprise two tubes of 30' each (although the lowermost tubes would be less than 30' in view of the elevation of the base flange 30 above the base plate 12).

On the other hand, if 120' of reinforcement of a pole was needed, the three splice clamping collars 92 could be positioned at heights of 30', 60' and 90' and the end clamping collar 38 would be positioned at a height of 120'. The vertical supports 24 would thus comprise four tubes of 30' each (although the lowermost tubes would be less than 30' in view of the elevation of the base flange 30 above the base plate 12). Additional intermediate clamping collars 46 would also be used in the portion of the pole between 90' and 120'.

In view of the foregoing, and using the gussets shown in FIG. 11 and the splice clamping collar shown in FIGS. 12 and 13, another possible reinforcement kit for reinforcing or retrofitting a pole in accordance with the invention would comprise gussets, tubes, assembled clamping collars or collar sections, and assorted threaded rods and bolts for connecting the collar sections to one another. The kit could be brought to the site of the pole and installation of the reinforcement arrangement in accordance with the invention would then be initiated.

To provide for easier installation, some components can be assembled at a factory or other off-site location. For example, the gussets 90 can be welded to the lower ends of tubes 36 and the upper ends of the tubes welded to a splice clamping collar section 94, and intermediate parts of the tubes 36 welded to intermediate clamping collar sections 56. A sub-assembly of three tubes 36, one or more intermediate clamping collar sections 56, a splice clamping collar section 94 and three gussets 90 would thus be formed. In this manner, installation of this sub-assembly about a pole would involve welding the gussets 30 to the base plate 12 and column 18 and attachment of the intermediate and splice clamping collar sections 56, 94 together around the circumference of the column 18 to thereby form the intermediate and splice clamping collar 40, 92.

Also, upper ends of additional tubes can be welded to a splice clamping collar section 94 or end clamping collar section 42, and intermediate parts of the tubes 36 welded to intermediate clamping collar sections 56. A sub-assembly of three tubes 36, one or more intermediate clamping collar sections 56, and an end or splice clamping collar section 42, 94 would thus be formed. In this manner, installation of this sub-assembly about a pole would involve welding the lower ends of the tubes to a splice clamping collar section 94 and attachment of the intermediate and end or splice clamping collar sections 56, 42, 94 together around the circumference of the column 18 to thereby form the intermediate and end or splice clamping collar 40, 38, 92

Referring now to FIGS. 14–17, another embodiment of a reinforcement arrangement in accordance with the invention is shown.

In this embodiment, each vertical tube 102 extends from the base plate 12 to an uppermost horizontal collar 104*a*. The vertical tubes 102 extend alongside the column 18 and each vertical tube 102 is securely attached to the base plate 12 by appropriate means such as a gusset or stiffener member 106 attached to the base plate 12. A strong, pressure-bearing bond is formed between the stiffener member 106 and the base plate 12, e.g., welding. Each stiffener member 106 is a rigid, substantially polygonal piece of steel, although other rigid materials could be used. The stiffener members 106 are preferably also welded to an adjacent portion of the column 18 to provide additional structural integrity and support.

Vertical tubes 102 can extend end-to-end from a respective stiffener member 106 at the bottom of the column 18 to the uppermost collar 104*a*. Tubes 102 may be made of steel or another rigid material. Instead of tubes, solid rods may be used.

To facilitate attachment of the lowermost tube 102 to a respective stiffener member 106, each lowermost tube 102 has a longitudinal slit 108 extending inward from a lower edge for receiving a respective stiffener member 106 with the tube 102 being securely attached to the stiffener member 106 by appropriate attachment means. For example, apertures are provided in the stiffener member 106 and aligning apertures are provided in the lower end of the tube 102 so that bolts are insertable through the apertures and when tightened, secure the tube 102 to the stiffener member 106. Other means for attaching the lowermost tubes 102 to the stiffener members 106 are also contemplated to be within the scope and spirit of the invention, e.g., welding.

The lowermost tubes 102 can also be attached to the base plate using the base flange 30 and gussets as discussed above.

If vertical tubes 102 are arranged end-to-end, then ends of adjacent tubes are spliced together. To this end, a sleeve 110 overlies the ends of adjacent tubes 102 with each tube 102 being inserted partially into the sleeve 110 (see FIG. 15). Sleeve 110 is hollow and elongate and has a cross-sectional shape designed to receive the tubes 102 and enable the tubes 102 to be positioned therein. Sleeve 110 includes a series of apertures and the adjacent ends of the tubes 102 are provided with apertures in alignment with apertures in the sleeve 110 to enable bolts 112 to pass therethrough and once tightened, to secure the sleeve 110 to each tube 102.

Instead of sleeves 110, other means for permanently or removably attaching or joining the ends of adjacent tubes together may be used, when a plurality of such tubes are present in a vertical support. For example, the splice clamping collars 92 discussed above may be used.

Also, a side plate could be provided with apertures in alignment with apertures in each of the tubes 102 so that bolts pass through the side plate and tubes and when tightened, secure the tubes together.

As to permanently attaching the ends of adjacent tubes together, the ends of the adjacent tubes may be welded together or a splice clamping collar as disclosed above can be used whereby the adjacent ends of vertically adjacent tubes are welded to a common substrate. Of course, if a vertical support comprises a single tube extending from the base plate to the uppermost collar 104*a*, then attachment means are not necessary.

Each horizontal collar 104 extends completely around the circumference of the column 18 and comprises a plurality of collar segments 114, each collar segment 114 extending partially around the circumference of the column 18. A collar segment 114 comprises a main body portion having a shape conforming to the shape of that portion of the column against which the main body portion will abut. In the illustrated embodiment, the column has a polygonal cross-sectional shape with several planar sides so that the main body portion of each collar segment 114 has a series of planar segments 118, with adjacent segments 118 being angled with respect to one another. A flange 120 is arranged at each end of the main body portion to enable attachment of the collar segments 114 together. Each flange 120 includes apertures to enable bolts 122 to pass therethrough to secure one collar segment 114 to an adjacent collar segment 114. Other means for attaching the collar segments 114 together are within the purview of the invention.

The collar segments 114 are preferably fixedly attached to the column 18, e.g., by welding. However, the collar segments 114 do not have to be fixedly connected to the column 18. Rather, the collars segments 114 may be joined together and once joined together, the thus-formed collar 104 is clamped onto the column 18. The clamp-on collars 104 are preferably made of steel or another rigid material.

If the column 18 is constructed with an upward taper, the collars 104 are also sized and shaped accordingly so that a lower collar would have a larger circumference than an upper collar. However, it is also possible to provide a uniform collar segment and alter the attachment means to compensate for variations in the circumference of the column 18.

There are three collar segments 114 whereby each collar segment 114 is designed to extend about 120 degrees around the circumference of the column 18. The collar segments 114 can be designed to extend over a different circumferential portion of the column 18, e.g., 90 degrees, in which case, four collar segments would be used.

Figure 17:
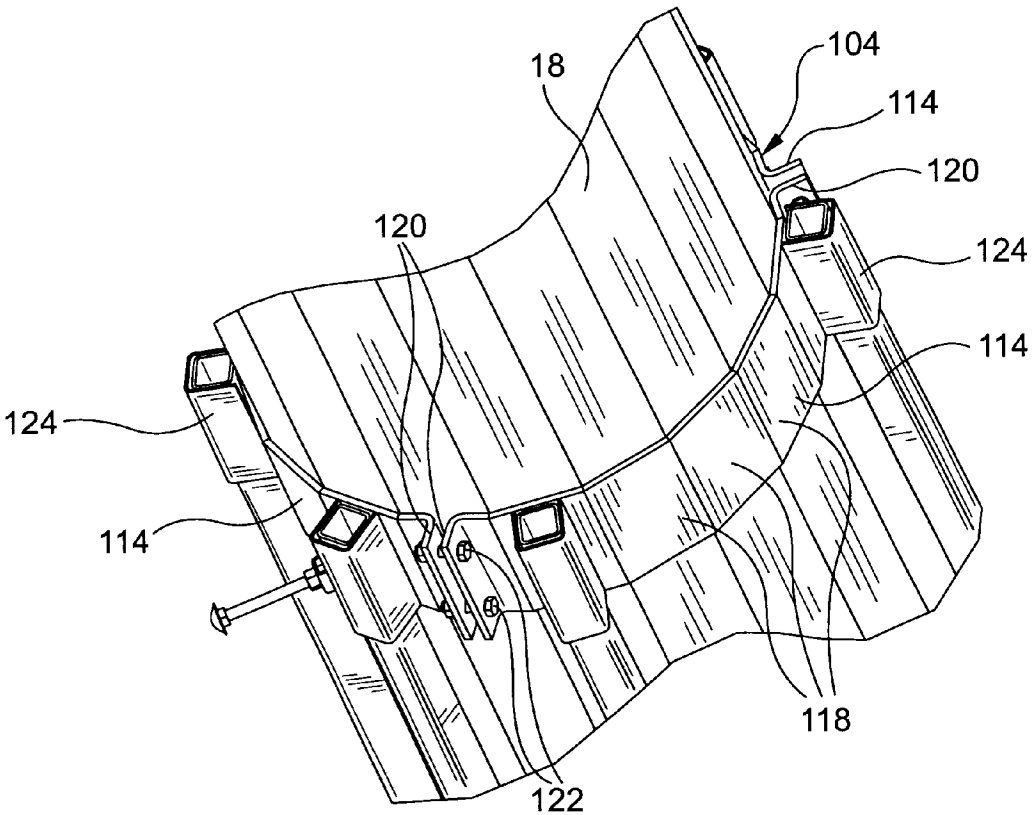
FIG. 17 is a perspective view of an assembled end clamping collar of the second embodiment of the reinforcement arrangement in accordance with the invention.

Each collar segment 114 further includes U-shaped brackets 124 arranged on the outer surface of some of the planar segments 118 to thereby define channels (see FIG. 17). Brackets 124 are sized and shaped such that the channels defined between the brackets 124 and the planar segments 118 are capable of receiving the tubes 102. The edges of the brackets 124 are fixed to the outer surface of the planar segments 118.

In use, a reinforcement kit for reinforcing or retrofitting a pole in accordance with this embodiment of the invention would be packaged and sold and would comprise stiffener members, tubes, collar segments, sleeves, brackets and assorted threaded rods and bolts for connecting the collar segments to one another. The kit could be brought to the site of the pole and installation of the reinforcement arrangement in accordance with the invention would then be initiated.

To provide for easier installation, some components can be assembled at a factory or other off-site location. For example, the stiffener members can be attached to the lower ends of tubes and thus sub-assembly delivered to the installation site.

Attachment of the reinforcement arrangement in accordance with the immediately foregoing embodiment thus involves the following steps:

1. Welding the stiffener members to the base plate 12 and column 18.
2. Attaching the collar segments to the column at desired locations, e.g., by welding and attaching the collar segments to one another using threaded rods and nuts.
3. Attaching two tubes to each sleeve.
4. Attaching the lower end of the tubes to the stiffener members and placing the tubes alongside the collar segments.
5. Attaching the U-shaped brackets to the collar segments with the tubes enclosed by the brackets.

The foregoing steps are generally those needed for a basic installation of a reinforcement arrangement in accordance with this embodiment invention. However, the steps may be performed in numerous different orders and thus the order of steps set forth above is not intended to limit the invention.

Accordingly, the method for reinforcing a pole in accordance with this aspect of the invention entails arranging annular clamping collars around the column at different vertical locations, attaching elongate tubes to the base plate at discrete locations around a circumference of the column, the tubes extending vertically alongside the column, and attaching the tubes to the clamping collars such that a skeletal framework is formed around the column. The tubes can be attached by fixing rigid stiffener members to the base plate and the column and fixing the stiffener members each to a lower end of a respective one of the tubes. The clamping collars may be arranged around the column by arranging a plurality of clamping collar sections each around a portion of the circumference of the column and attaching adjacent clamping collar sections together. A space is formed between inner and outer walls in at least one clamping collar and the tubes fixed in this space.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, although the reinforcement arrangement is described for use in particular with a pole supporting one or more communication antennas, the reinforcement arrangement can be applied to any type of vertical structure for which reinforcement is desired.

What is claimed is:

1. A reinforcement arrangement for a pole having a base plate connected to a supporting foundation and a column attached to the base plate, the reinforcement arrangement comprising:

a base flange adapted to surround a lower portion of the column and be attached to the base plate;

elongate supports attached to said base flange at discrete locations around a circumference of the column and extend vertically alongside the column;

annular clamping collars adapted to be arranged around the column at different vertical locations, said clamping collars engaging with said supports to thereby form a skeletal framework around the column, wherein each of said collar segments further comprises an inner wall adapted to conform to an adjacent portion of the column and an outer wall spaced from said inner wall to thereby define a space in which said ends of said supports are situated, said ends of said supports being attached to said inner and outer walls.

2. The reinforcement arrangement of claim 1, further comprising gussets connected to said base flange and adapted to be connected to the base plate for supporting said base flange above the base plate.

3. The reinforcement arrangement of claim 1, wherein said clamping collars include an end clamping collar for clamping ends of said supports, said end clamping collar comprising a plurality of collar segments, each of said collar segments being adapted to extend partially around the circumference of the column, adjacent ones of said collar segments being attached to one another.

4. The reinforcement arrangement of claim 3, wherein a lowermost end of each of said supports is attached to said base flange and an uppermost end of each of said supports is attached to said end clamping collar.

5. The reinforcement arrangement of claim 1, wherein said supports each comprise a tube.

6. The reinforcement arrangement of claim 1, wherein said clamping collars include an intermediate clamping collar attached to intermediate portions of said supports, said intermediate clamping collar comprising a plurality of collar segments, each of said collar segments being adapted to extend partially around the circumference of the column, adjacent ones of said collar segments being attached to one another.

7. The reinforcement arrangement of claim 6, wherein each of said collar segments comprises a wall adapted to conform to an adjacent portion of the column, said intermediate portions of said supports being attached to said wall.

8. The reinforcement arrangement of claim 1, wherein at least one of said clamping collars comprises a plurality of collar segments, each of said collar segments being adapted to extend partially around the circumference of the column, adjacent ones of said collar segments being attached to one another.

9. The reinforcement arrangement of claim 8, wherein each of said collar segments includes a main body portion shaped to conform to the circumference of the column.

10. A reinforcement arrangement for a pole having a base plate connected to a supporting foundation and a column attached to the base plate, the reinforcement arrangement comprising:

elongate supports adapted to be attached to the base plate at discrete locations around a circumference of the column and extend vertically alongside the column; 0 and annular clamping collars adapted to be arranged around the column at different vertical locations, said clamping collars engaging with said supports to thereby form a skeletal framework around the column, wherein said clamping collars include an end clamping collar for clamping ends of said supports, said end clamping collar comprising a plurality of collar segments, each of said collar segments being adapted to extend partially around the circumference of the column, adjacent ones of said collar segments being attached to one another, each of said collar segments comprising an inner wall adapted to conform to an adjacent portion of the column and outer wall spaced from said inner wall to thereby define a space in which said ends of said supports are situated, said ends of said supports being attached to at least one of said inner and outer walls.

11. The reinforcement arrangement of claim 10, wherein at least one of said supports comprises a stiffener member adapted to be fixed to the base plate and the column.

12. The reinforcement arrangement of claim 10, wherein said clamping collars include an intermediate clamping collar attached to intermediate portions of said supports, said intermediate clamping collar comprising a plurality of collar segments, each of said collar segments being adapted to extend partially around the circumference of the column, adjacent ones of said collar segments being attached to one another, each of said collar segments comprising an inner wall adapted to conform to an adjacent portion of the column, said intermediate supports being attached to said inner wall.

13. The reinforcement arrangement of claim 10, wherein each of said supports comprises a plurality of tubes, said clamping collars including a splice clamping collar attached to ends of vertically adjacent ones of said tubes, said splice clamping collar comprising a plurality of collar segments, each of said collar segments being adapted to extend partially around the circumference of the column, adjacent ones of said collar segments being attached to one another, each of said collar segments comprising a wall adapted to conform to an adjacent portion of the column, said ends of said tubes being attached to said wall.

14. The reinforcement arrangement of claim 10, wherein at least one of said clamping collars comprises a plurality of collar segments, each of said collar segments being adapted to extend partially around the circumference of the column, adjacent ones of said collar segments being attached to one another, each of said collar segments including a main body portion shaped to conform to a portion of the circumference of the column and U-shaped brackets attached to an outer surface of said main body portion to define channels, each of said channels being receivable of a portion of a respective one of said supports.

15. A reinforced pole, comprising:

a supporting foundation;

a base plate connected to said foundation;

a column attached to said base plate;

a base flange attached to said base plate and surrounding a lower portion of the column;

elongate tubes attached to said base flange at discrete locations around a circumference of said column and extend vertically alongside said column; and annular clamping collars arranged around said column at different vertical locations, said clamping collars engaging with said tubes to thereby form a skeletal framework around said column.

16. The pole of claim 15, further comprising gussets connected to said base flange and said base plate for attaching said base flange to said base plate.

17. The pole of claim 15, wherein said clamping collars include an end clamping collar for clamping ends of said supports, said end clamping collar comprising a plurality of collar segments, each of said collar segments extending partially around the circumference of said column, adjacent ones of said collar segments being attached to one another.

18. The pole of claim 17, wherein each of said collar segments comprises an inner wall abutting an adjacent portion of said column and an outer wall spaced from said inner wall to thereby define a space in which said ends of said tubes are situated, said ends of said tubes being attached to said inner and outer walls.

19. The pole of claim 17, wherein a lowermost end of each of said tubes is attached to said base flange and an uppermost end of each of said tubes is attached to said end clamping collar.

20. The pole of claim 15, wherein said clamping collars include an intermediate clamping collar attached to intermediate portions of said tubes, said intermediate clamping collar comprising a plurality of collar segments, each of said collar segments extending partially around the circumference of said column, adjacent ones of said collar segments being attached to one another.

21. The pole of claim 20, wherein each of said collar segments comprises a wall abutting an adjacent portion of said column, said intermediate portions of said tubes being attached to said wall.

22. The pole of claim 15, wherein at least one of said clamping collars comprises a plurality of collar segments, each of said collar segments extending partially around the circumference of said column, adjacent ones of said collar segments being attached to one another.

* * * * *

UNITED STATES PATENT AND TRADEMARK OFFICE

CERTIFICATE OF CORRECTION

PATENT NO. : 6,901,717 B2 
DATED : June 7, 2005
INVENTOR(S) : Jeffrey R. Brunozzi, Brian R. Reese and David W. Hawkins It is certified that error appears in the above-identified patent and that said Letters Patent is hereby corrected as shown below:

Title page,
Item [75], Inventors, correct the spelling of the third inventor's name from "David D. Hawkins" to -- David W. Hawkins --.

Signed and Sealed this

Sixth Day of September, 2005

JON W. DUDAS
*Director of the United States Patent and Trademark Office*